US005222672A

United States Patent [19]

Hart et al.

[11] Patent Number: 5,222,672

[45] Date of Patent: Jun. 29, 1993

[54] WATER SPOUT WITH PLURALITY OF ARCUATELY DISPOSED OUTLETS

[75] Inventors: Thomas G. Hart, North Brunswick, N.J.; Robin H. Levien, Islington, United Kingdom

[73] Assignee: American Standard Inc., New York, N.Y.

[21] Appl. No.: 869,077

[22] Filed: Apr. 13, 1992

Related U.S. Application Data

[63] Continuation of Ser. No. 598,911, Oct. 16, 1990, abandoned.

[51] Int. Cl.[5] ..... B05B 1/14

[52] U.S. Cl. ..... 239/553.5; 239/590

[58] Field of Search ..... 239/548, 553, 567, 553.5, 239/558, 559, 590; 4/192

[56] References Cited

U.S. PATENT DOCUMENTS

| | | | |
|---|---|---|---|
| 1,714,694 | 5/1929 | Riley | 239/567 X |
| 2,626,524 | 1/1953 | Harman | 239/567 X |
| 2,874,001 | 2/1959 | Webb | 239/559 X |
| 3,321,140 | 5/1967 | Parkison | 239/553.3 |
| 4,480,793 | 11/1984 | Grande | 239/567 |
| 4,662,768 | 5/1987 | Gottwald et al. | 239/587.2 X |
| 4,709,717 | 12/1987 | Rannigan et al. | 239/567 X |

FOREIGN PATENT DOCUMENTS

| | | | |
|---|---|---|---|
| 689010 | 4/1965 | Italy | 239/567 |

*Primary Examiner*—Andres Kashnikow
*Assistant Examiner*—Kevin Weldon
*Attorney, Agent, or Firm*—Elaine B. Robinson; Ann M. Knab

[57] ABSTRACT

The present invention comprises a water spout for use in a bathtub, sink or the like and has at least one inlet and a plurality of outlets for discharging the water. The outlets are arranged in arcuate fashion and are sufficiently spaced to enable discrete streams of water to flow from the outlets. The outlets are disposed substantially in a single plane and define a central arc having an angle less than 180°.

21 Claims, 7 Drawing Sheets

WATER SPOUT WITH PLURALITY OF ARCUATELY DISPOSED OUTLETS

This is a continuation of application Ser. No. 07/598,911, filed on Oct. 16, 1990 now abandoned.

The present invention is directed to a water spout and, more particularly, to a water spout having a plurality of outlets disposed in an arcuate fashion.

BACKGROUND OF THE INVENTION

Conventional water spouts useful for bathtubs, sinks, and the like typically have a single outlet. Such single-outlet spouts have been designed in many configurations, to provide a variety of flow patterns, albeit with a single stream.

Since surfaces in need of rinsing often comprise curved surfaces, for example body parts, it would be very useful to provide a spout with a plurality of outlets disposed in arcuate fashion. It would also be helpful to supply such outlets with water from more than one inlet.

SUMMARY OF THE INVENTION

The present invention comprises a water spout for use in a bathtub, sink or the like having at least one inlet and a plurality of outlets for discharging the water which are arranged in arcuate fashion and are sufficiently spaced to enable discrete streams of water to flow from the outlets. The outlets are disposed substantially in a single plane and define a central arc having an angle less than 180°.

DETAILED DESCRIPTION

The present invention comprises a spout which delivers a plurality of discrete streams of water arranged in an arcuate manner. The spout of the present invention comprises at least one inlet for receiving a flow of water. Those skilled in the art will appreciate that the spout of the present invention can be used with either a single hot or cold stream of water or with a mixed stream of hot and cold water which have already been mixed at some point upstream of the spout. The present invention is particularly adapted to provide discrete streams of water with each stream emanating from a discrete outlet. In this regard, the outlets of the present invention are sufficiently spaced to provide a total water fall comprising discrete streams of water. When the present invention is utilized to dispense an already mixed, i.e. hot and cold, stream of water, additional time is provided for the temperature of the water to equilibrate.

Figure 1:
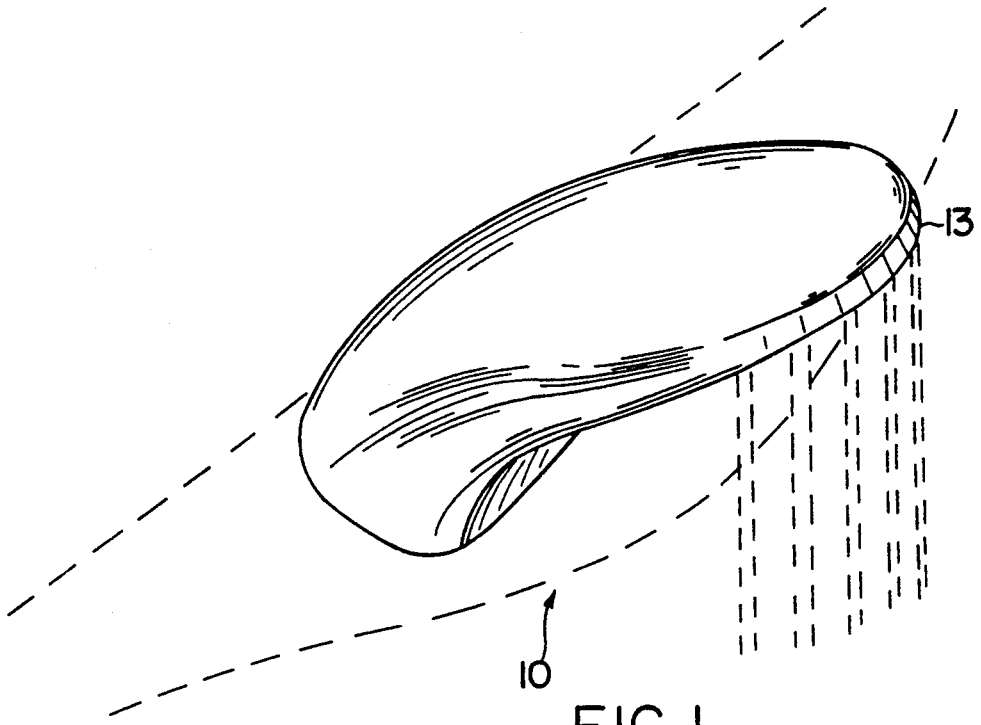
FIG. 1 is a top perspective view of one embodiment of the present invention mounted on a bathtub illustrated in phantom.
Figure 2:
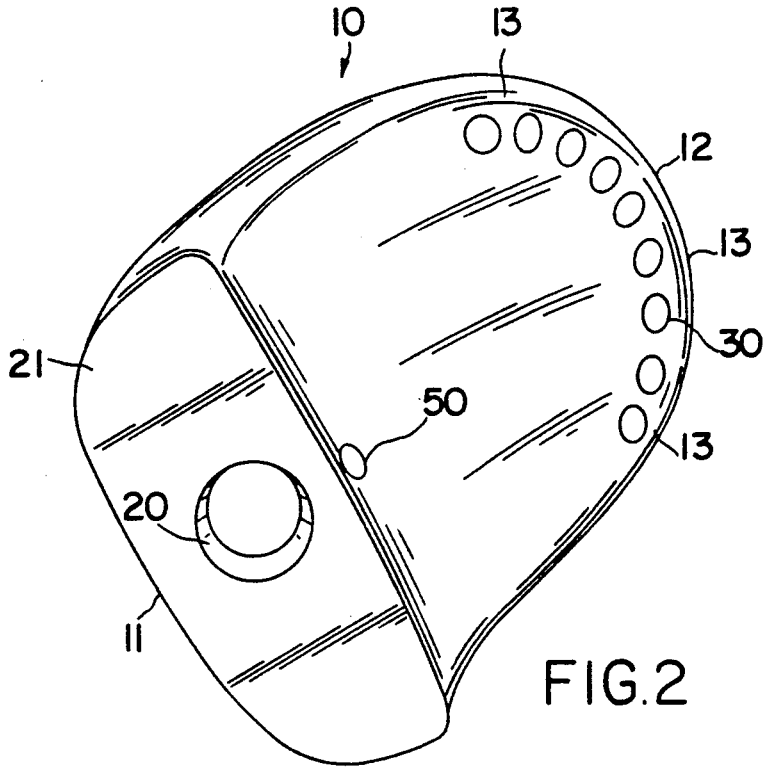
FIG. 2 is a bottom perspective view of the spout illustrated in FIG. 1.
Figure 8:
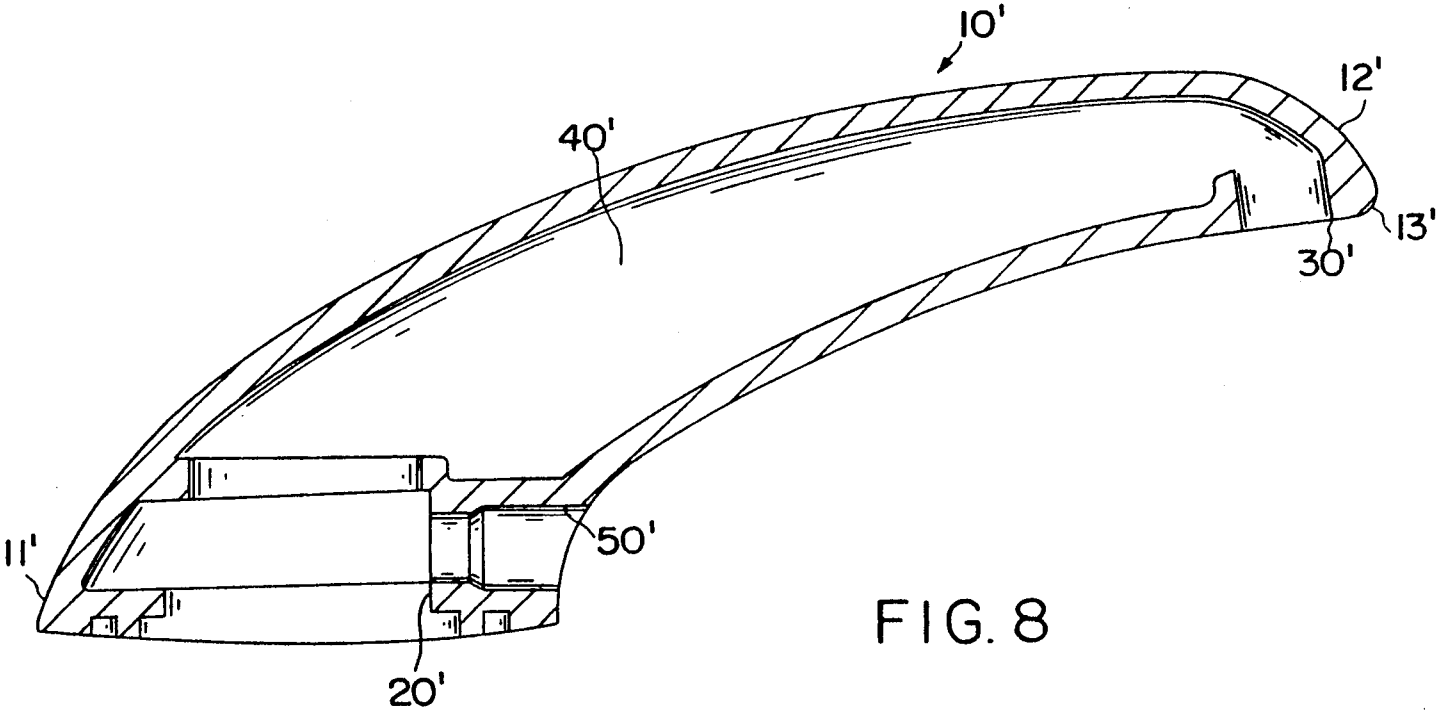
FIG. 8 is a cross-sectional side view of another embodiment of the invention showing the spout having a convex bottom surface.
Figure 9:
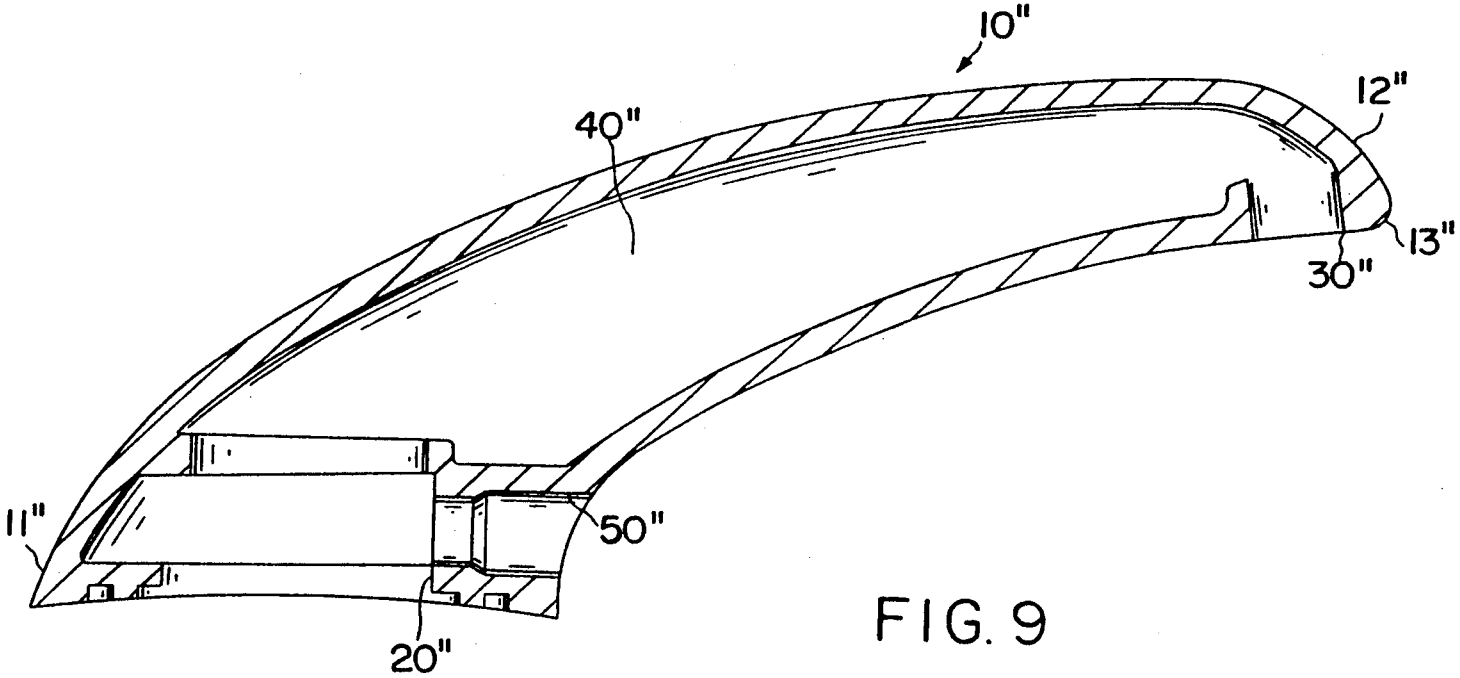
FIG. 9 is a cross-sectional side view of another embodiment of the invention showing the spout having a concave bottom surface.
Figure 10:
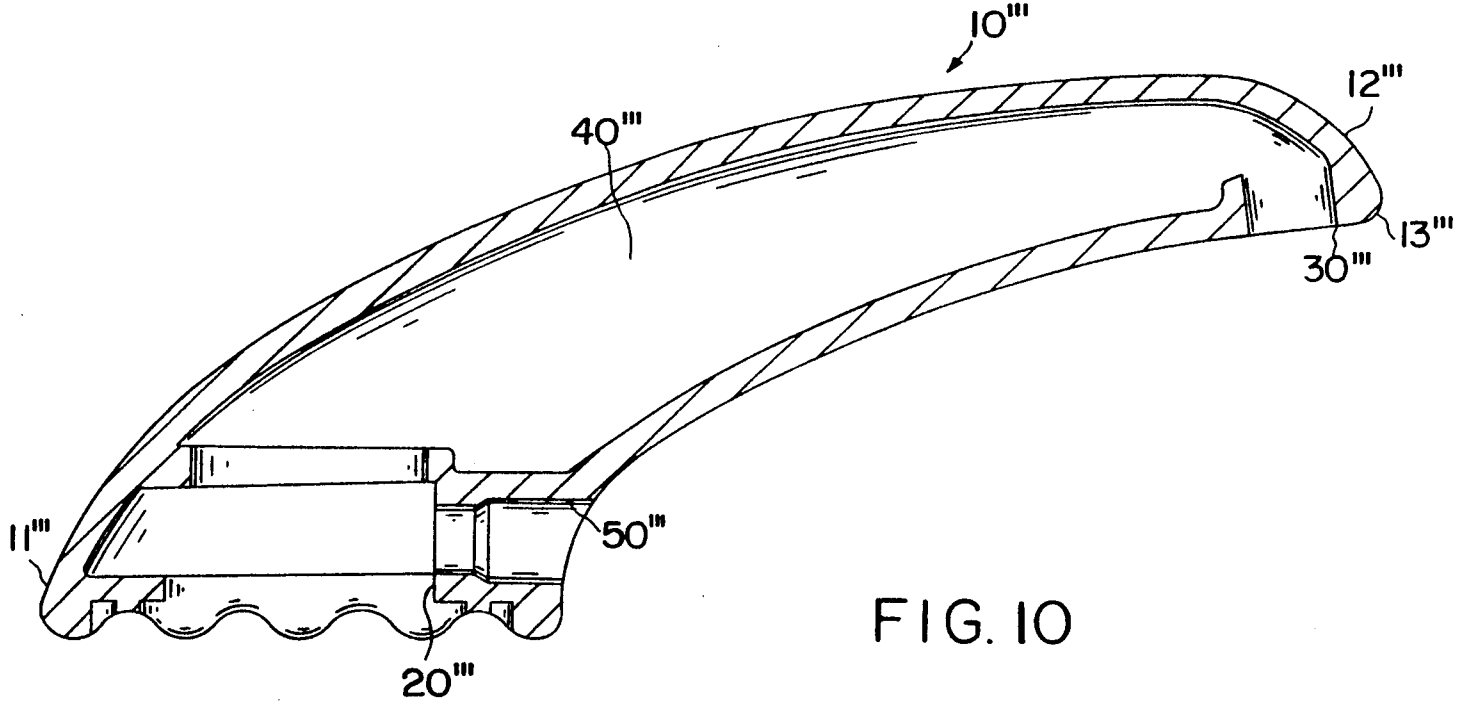
FIG. 10 is a cross-sectional side view of another embodiment of the invention showing the spout having a wave-like bottom surface.

One embodiment of the present invention is illustrated in FIG. 1 which shows the discrete streams emanating from spout 10 which is mounted on the side of a bathtub which is partially illustrated in phantom. With reference to FIG. 2, spout 10 comprises an inlet 20 which is preferably disposed on a bottom surface 21 for easy mounting on the desired fixture. The bottom surface may be substantially planar or may take any other desired configuration such as convex, concave, or even a wave-like design to facilitate secure mounting of spout 10 onto the desired fixture. These configurations are depicted in FIGS. 8 through 10.

Figure 4:
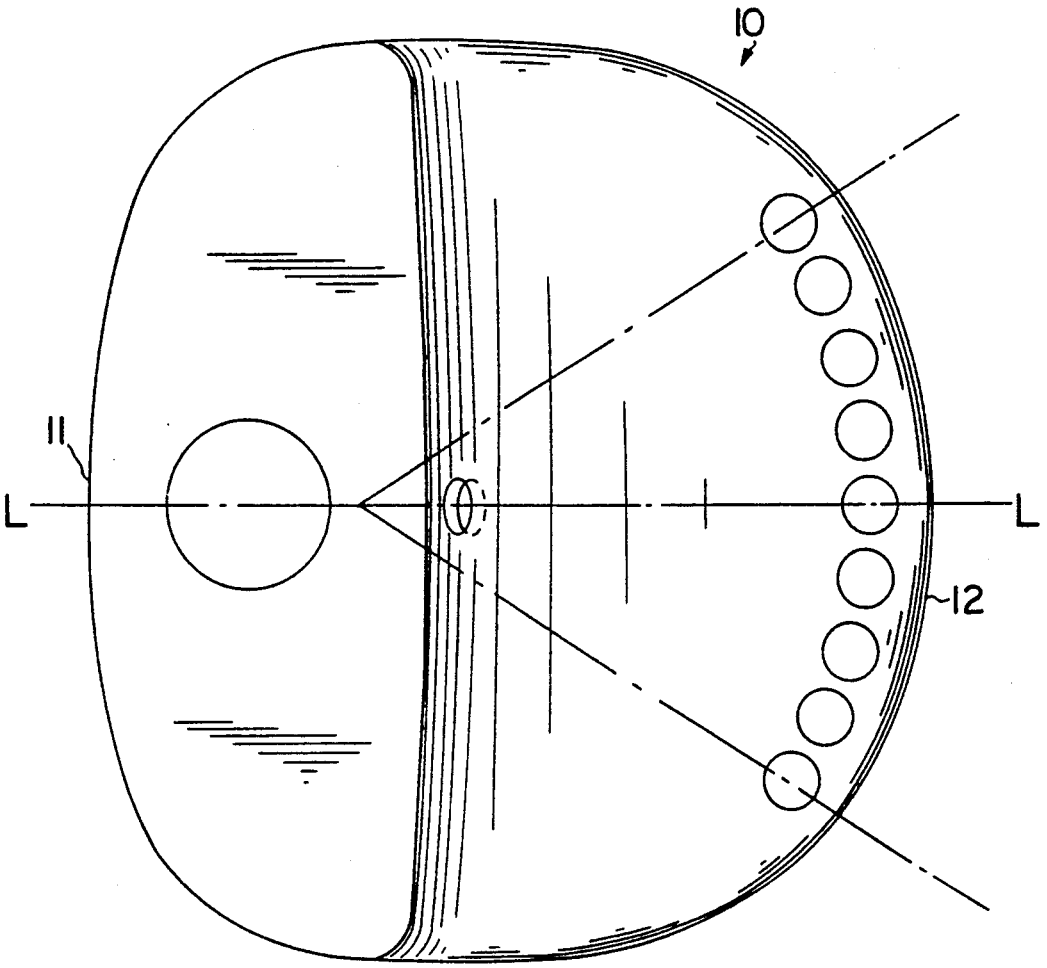
FIG. 4 is a bottom view of the spout illustrated in FIG. 1.

In this illustrated embodiment of the present invention, spout 10 is provided with nine cylindrical outlets 30 disposed near the forward end 12 of spout 10. The outlets 30 are arranged in an arcuate fashion having a common radius about a center point C, as best shown in FIG. 4. The outlets 30, in this illustrated embodiment of the present invention, are symmetrically arranged about a central axis L—L passing through the center of inlet 20, center point C and the middle outlet. The outlets according to this embodiment define a central arc of about 65°. As used herein, the term "central arc" is the interior angle formed by extending lines from the middle of the two outer outlets to center point C. In accordance with the present invention, the central arc is preferably less than 180°, more preferably less than about 140° and most preferably less than about 90°. While the present invention has been illustrated having a center point C which is somewhere on the spout, the present invention is not so limited. The center point may be disposed rearwardly of rear end 11 or may be at some distance forward of forward end 12 of spout 10. The central arc radius, i.e. the distance between center point C and the middle of the outlets, is preferably about 1–10 inches and most preferably about 3–5 inches.

While the outlets 30 of the illustrated embodiment are substantially circular, outlets having different shapes may be utilized without departing from the scope of the present invention. The present invention is most preferably practiced with at least four outlets and preferably with at least five outlets disposed in an arcuate manner.

Figure 3:
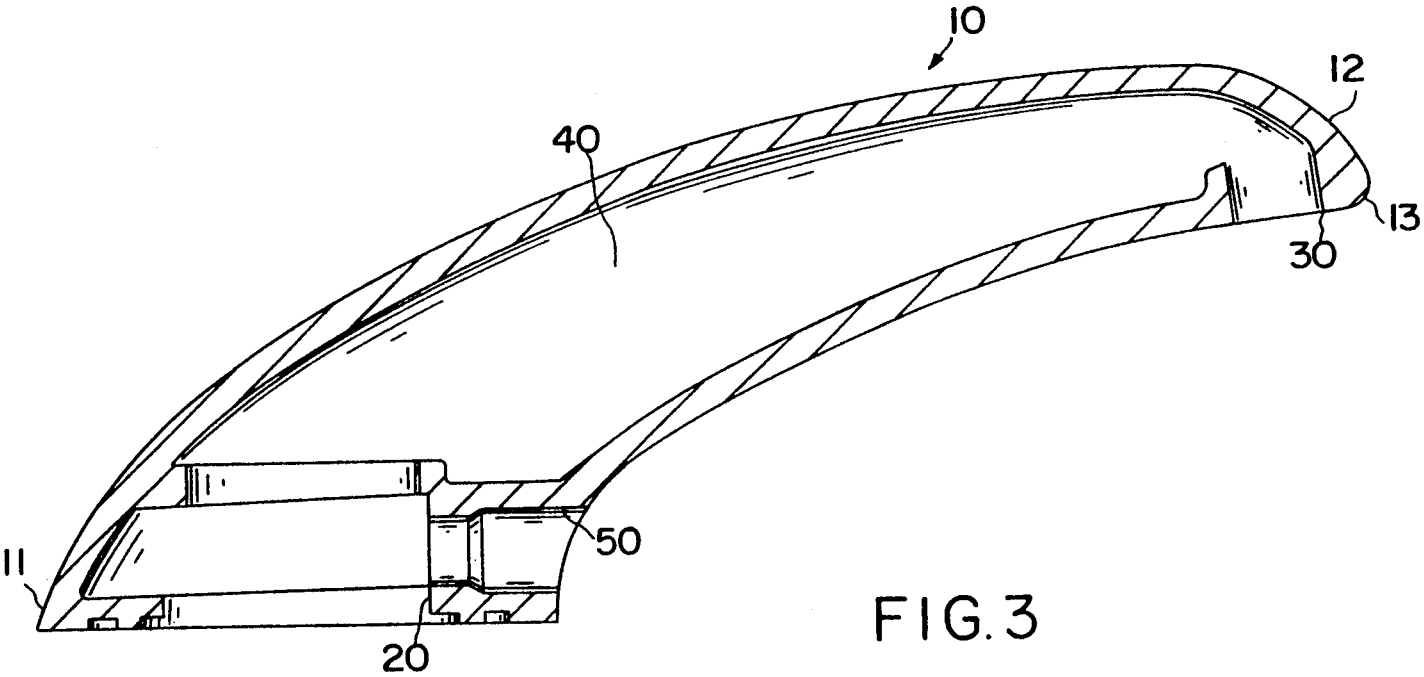
FIG. 3 is a cross-sectional side view taken along lines 3—3 of FIG. 1.

Outlets 30 are properly spaced and are designed to avoid the converging of streams emanating from each of the outlets. In this regard the spacing between the circular outlets illustrated in FIG. 3 is preferably at least about 10–50% of the radius of each of the outlets 30. The streams preferably remain separate up to distance of about 12 to 24 inches and preferably about 18 inches below outlets 30 when spout 10 is supplied with water at typical "bathroom" water pressures e.g. about 20–120 pounds per square inch. Those skilled in the art will appreciate that different spacings may be utilized without departing from the scope of the present invention and that spacing requirements may vary for outlets having different configurations.

Figure 6:
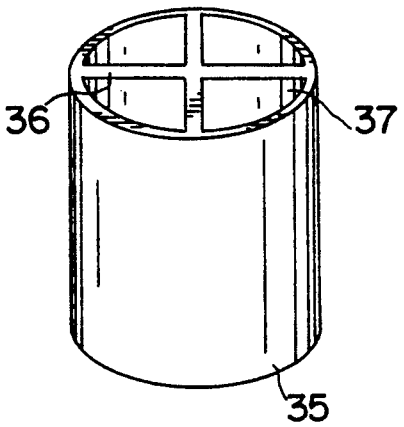
FIG. 6 is a perspective view of a stream straightener of one embodiment of the present invention.
Figure 7:
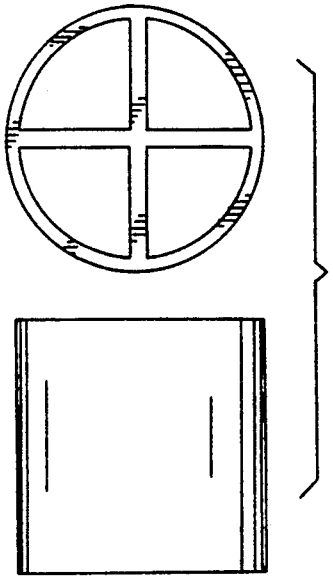
FIG. 7 is an end view of the stream straightener , illustrated in FIG. 6.

In order to maintain the discrete outflowing streams, each outlet 30 is also preferably provided with a stream straightener 35. As illustrated in FIGS. 6 and 7, a stream straightener 35 may simply take the shape of a cylinder having interior cross members 36, 37 which help direct water flowing through outlets 30 toward the central longitudinal axis of the outlets and to avoid the divergence of the outflowing streams. By providing a plurality of outlets 30 with individual stream straighteners 35, it has been found that better overall stream control may be obtained, resulting in less splashing, when compared to a single outlet of the same area.

In the preferred illustrated embodiment of the present invention, the outlets 30 are advantageously positioned proximate the forward edge 13 of spout 10. With reference to FIG. 3, it will be appreciated that by positioning outlets 30 toward the forward edge 13 of spout 10, the smooth flow of water to outlet 30 is enhanced.

According to the illustrated embodiment of the present invention, the total outlet area which is defined by the sum of the areas of outlets 30, is greater than the area of inlet 20. This embodiment advantageously serves to reduce the water pressure between inlet 20 and outlets 30. Alternative embodiments may be sized conversely resulting in an increase in the flow rate through the outlets, rather than a decrease.

In the illustrated preferred embodiment of the present invention, the entire forward end 11 of spout 10 is arcuately shaped as illustrated in the figures. In this manner, outlets 30 may each be positioned equidistant from the bottom forward edge 13 of spout 10.

Spout 10 is also preferably provided with mounting means 50 such as a horizontally disposed bore adapted to receive a retaining screw for mounting spout 10 onto a conventional bathroom fixture. Those skilled in the art will appreciate that alternative methods may be used for mounting the spout of the present invention on a fixture.

Figure 5:
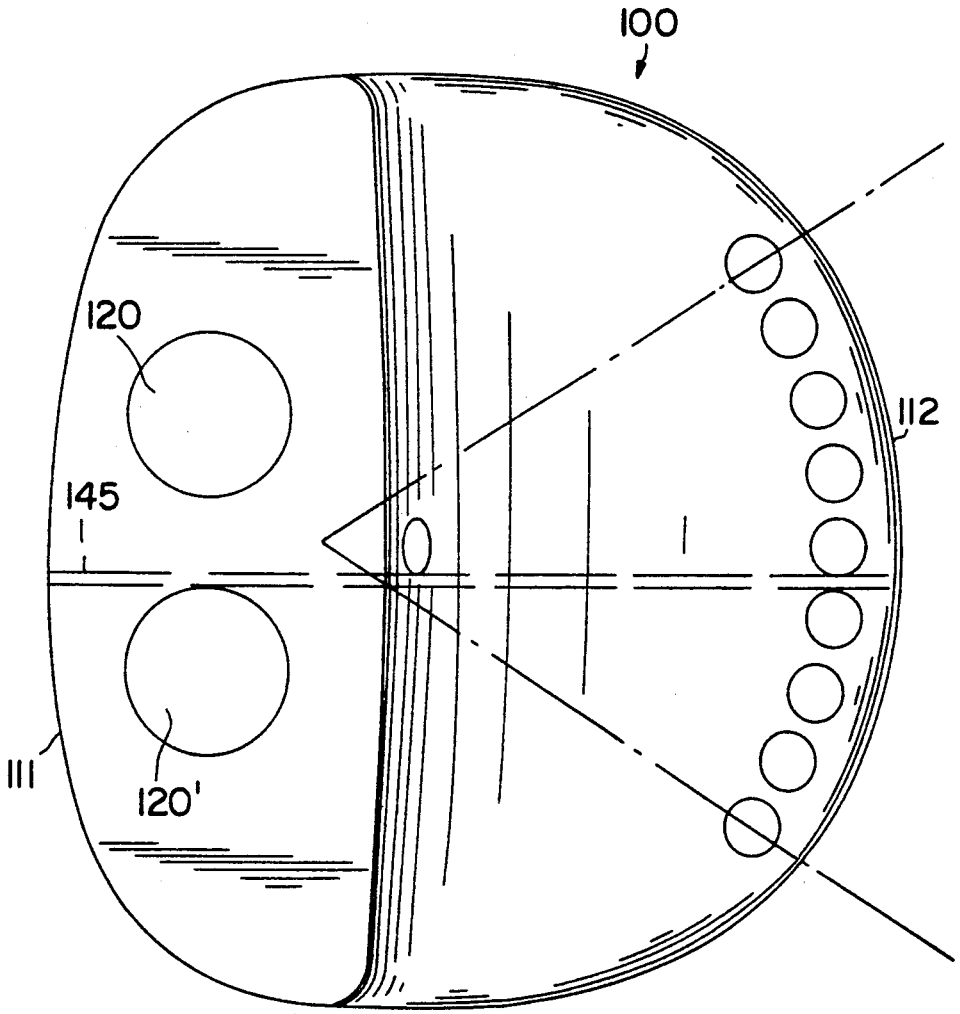
FIG. 5 is a bottom view of an alternative embodiment of the present invention.

According to another embodiment of the present invention illustrated in FIG. 5, spout 100 with rear end 111 and forward end 112 is provided with a plurality of inlets 120, 120'. In this manner, spout 100 may be provided with separate inlet streams, for example, one stream for cold water and another stream for hot water. While the water may be permitted to mix and thereby allow temperature equilibration within spout 100, inner conduit may also be provided with a separator 145 in order to keep the two inflowing streams separate. In this manner, some outlets will dispense hot water while other outlets will dispense cold water. Those skilled in the art will appreciate that the advantages of the present invention are still achieved provided that the outlets are arranged in arcuate fashion.

The spout of the present invention may advantageously be formed of conventional materials, including plastic and more preferably brass.

What is claimed is:

1. A water spout for use with a bathtub and a sink comprising:

an inlet for receiving water;

a plurality of outlets for discharging water arranged in arcuate fashion having a common radius about a common central point and sufficiently spaced from each other by at least 10% to 50% of their respective radii to enable discrete streams of water to flow from each of said outlets for a distance of 12 to 24 inches before said streams merge;

said outlets having a total water discharge cross-sectional area greater than the cross-sectional area of said inlet;

a stream straightener inserted within each outlet;

said outlets disposed substantially in a single plane, such that a central arc may be drawn from said central point to the two outer most outlets;

wherein the central arc of said outlets comprises an angle of less than 180°; and means for directing water from said inlet to said outlets.

2. A water spout according to claim 1 further comprising a forward end and a rearward end and wherein said outlets are disposed in said forward end.

3. A water spout according to claim 2 wherein said forward end comprises a substantially arcuate edge.

4. A water spout according to claim 3 wherein said outlets are disposed proximate said substantially arcuate edge.

5. A water spout according to claim 1 wherein said central arc comprises an angle of less than about 140°.

6. A water spout according to claim 1 wherein said central arc comprises an angle of less than about 90°.

7. A water spout according to claim 1 further comprising a plurality of inlets.

8. A water spout according to claim 1 wherein said outlets are substantially circular and the distance between adjacent outlets is about ½–5 times the radius of said outlets.

9. A water spout according to claim 7 wherein the distance between adjacent outlets is about 1–3 times the radius of said outlets.

10. A water spout according to claim 1 wherein all of said outlets are the same size.

11. A water spout for use with a bathtub and a sink comprising:

an inlet for receiving water;

a plurality of outlets for discharging water arranged in arcuate fashion having a common radius about a common central point and sufficiently spaced from each other by at least 10% to 50% of their respective radii to enable discrete streams of water to flow from each of said outlets for a distance of 12 to 24 inches before said streams merge;

a forward end and a rearward end wherein said outlets are disposed in said forward end, said forward end comprising a substantially arcuate edge, said outlets disposed proximate said substantially arcuate edge, said rearward end being greater in width than said forward end;

said outlets having a total water discharge cross-sectional area greater than the cross-sectional area of said inlet;

said outlets disposed substantially in a single plane, such that a central arc may be drawn from said central point to the two outer most outlets;

wherein the central arc of said outlets comprises an angle of less than 90°; and means for directing water from said inlet to said outlets.

12. A water spout according to claim 4 wherein said rearward end is greater than said forward end.

13. A water spout according to claim 12 wherein said rearward end comprises a substantially planar bottom surface for securely mounting said spout to a bathtub or a sink.

14. A water spout according to claim 12 wherein said rearward end comprises a convex bottom surface for securely mounting said spout to a bathtub or a sink.

15. A water spout according to claim 12 wherein said rearward end comprises a concave bottom surface for securely mounting said spout to a bathtub or a sink.

16. A water spout according to claim 12 wherein said rearward end comprises a wavelike bottom surface for securely mounting said spout to a bathtub or a sink.

17. A water spout according to claim 11 wherein said rearward end comprises a substantially planar bottom surface for securely mounting said spout to a bathtub or a sink.

18. A water spout according to claim 11 wherein said rearward end comprises a convex bottom surface for securely mounting said spout to a bathtub or a sink.

19. A water spout according to claim 11 wherein said rearward end comprises a concave bottom surface for securely mounting said spout to a bathtub or a sink.

20. A water spout according to claim 11 wherein said rearward end comprises a wavelike bottom surface for securely mounting said spout to a bathtub or a sink.

21. A water spout for use with a bathtub and a sink comprising:

a forward end and a rearward end;

wherein said forward end comprises a substantially arcuate edge;

a plurality of inlets for receiving water;

a plurality of circular outlets for discharging water arranged in arcuate fashion having a common radius about a common central point and sufficiently spaced from each other by at least 10% to 50% of their respective radii to enable discrete streams of water to flow from each of said outlets for a distance of 12 to 24 inches before said streams merge;

said outlets having a total water discharge cross-sectional area greater than the cross-sectional area of said inlet;

a stream straightener inserted within each outlet;

said outlets disposed in said forward end and substantially in a single plane, such that a central arc may be drawn from said central point to the two outer most outlets;

said outlets disposed proximate said substantially arcuate edge;

wherein the central arc of said outlets comprises an angle of less than 90°; and means for directing water from said inlet to said outlet;

said rearward end being greater in width than said forward end;

said rearward end comprising a substantially planar bottom surface for securely mounting said spout to a bathtub or a sink.

* * * * *